US007819366B2

(12) United States Patent
Paga, Jr. et al.

(10) Patent No.: US 7,819,366 B2
(45) Date of Patent: Oct. 26, 2010

(54) PAINT BRUSH HOLDER

(76) Inventors: Henry F. Paga, Jr., 16165 Sprenger, Eastpointe, MI (US) 48021; Guy D. Vaiasicca, 3023 N. Vermont Ave., Royal Oak, MI (US) 48073

( * ) Notice: Subject to any disclaimer, the term of this patent is extended or adjusted under 35 U.S.C. 154(b) by 433 days.

(21) Appl. No.: 12/001,349

(22) Filed: Dec. 10, 2007

(65) Prior Publication Data

US 2009/0146022 A1 Jun. 11, 2009

(51) Int. Cl.
*A46B 17/02* (2006.01)

(52) U.S. Cl. ..... 248/110; 248/112; 248/113; 248/211; 248/302; 248/303

(58) Field of Classification Search ..... 248/110, 248/112, 113, 211, 302, 303
See application file for complete search history.

(56) References Cited

U.S. PATENT DOCUMENTS

| | | | | | |
|---|---|---|---|---|---|
| 1,551,242 | A * | 8/1925 | Dick | 248/146 |
| 2,315,269 | A * | 3/1943 | Morgillo | 248/110 |
| 2,952,364 | A | 1/1957 | Jacobson | |
| 3,905,476 | A * | 9/1975 | Foreman | 206/361 |
| 4,025,206 | A * | 5/1977 | Rubin | 401/123 |
| 4,721,225 | A * | 1/1988 | Sobel | 220/736 |
| 4,852,833 | A * | 8/1989 | Lockwood | 248/110 |
| 5,016,773 | A | 5/1991 | Lockwood | |
| 5,035,386 | A * | 7/1991 | Tucker | 248/110 |
| 5,046,623 | A | 9/1991 | Takacs | |
| 5,645,091 | A | 7/1997 | Hoeft | |
| 5,806,818 | A * | 9/1998 | Heywood | 248/213.2 |
| 5,829,603 | A | 11/1998 | Martineau | |
| 6,193,080 | B1 | 2/2001 | Castillo | |
| D486,320 | S | 2/2004 | Grimberg | |
| 7,118,078 | B2 * | 10/2006 | Vukas | 248/110 |
| 2005/0194275 | A1 | 9/2005 | Balogh | |
| 2007/0045132 | A1 | 3/2007 | Anderson | |

* cited by examiner

*Primary Examiner*—J. Allen Shriver, II
*Assistant Examiner*—Michael McDuffie
(74) *Attorney, Agent, or Firm*—Brooks Kushman P.C.

(57) ABSTRACT

An integral paint brush holder (10) having a base (22) and a post (24). The post (24) has a lower end (26), an intermediate portion (28) and an upper end (30). The lower end (26) is connected to the base (22). The intermediate portion (28) extends upwardly from the lower end (26) while the upper end (30) is supported above the intermediate portion (28). In addition, the paint brush holder (10) has at least one generally horizontal support (40) extending from the upper end (30) of the post (24) and having an associated distal end (46). Furthermore, the paint brush holder (10) has a hook (50) on the intermediate portion (28) of the post (24). The hook (50) is vertically between the base (22) and the support (40), and the hook (50) has a downwardly opening shape.

17 Claims, 4 Drawing Sheets

PAINT BRUSH HOLDER

BACKGROUND OF THE INVENTION

1. Field of the Invention

The invention relates to a paint brush holder.

2. Background Art

Prior art references include U.S. Patent Application Publication Nos. 2007/0045132 A1 and 2005/0194275 A1 and U.S. Pat. Nos. 6,193,080; 5,829,603; 5,645,091; 5,046,623; 5,016,773; 4,852,833; 4,721,225; 2,952,364; and D486,320.

SUMMARY OF THE INVENTION

In a first embodiment an integral paint brush holder is provided including a base and a post having a lower end supported by the base, an intermediate portion extending upwardly from the lower end and an upper end supported by the intermediate portion. In addition, the paint brush holder has at least one generally horizontal support extending from the upper end of the post and having an associated distal end. A hook of the paint brush holder is supported on the intermediate portion of the post at a location between the base and the support, and the hook has a downwardly opening shape.

The objects, features and advantages of the present invention are readily apparent from the following detailed description of the preferred embodiment when taken in connection with the drawings.

DETAILED DESCRIPTION OF THE PREFERRED EMBODIMENT(S)

Figure 1:
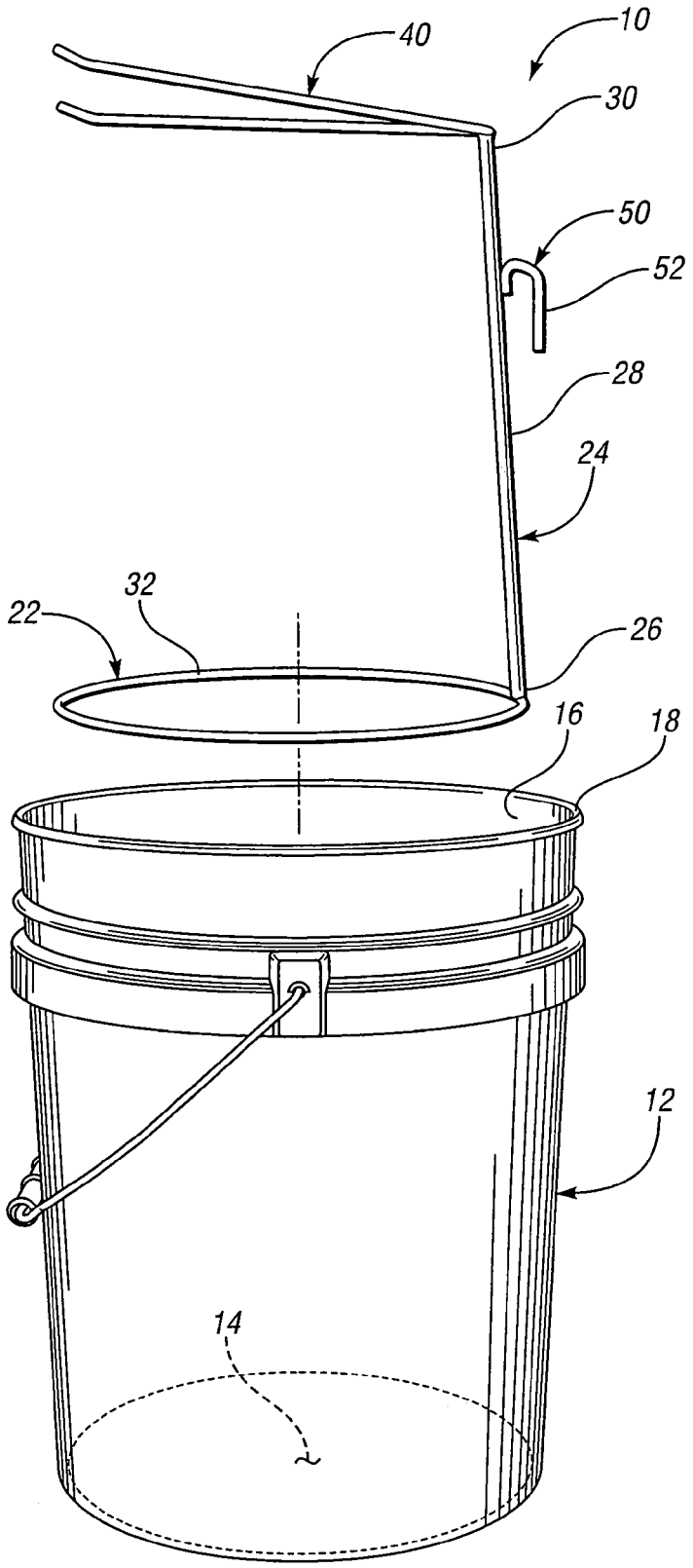
FIG. 1 is a perspective view illustrating an integral paint brush holder constructed in accordance with one embodiment of the invention and shown in preparation for use with a container.

With reference to FIG. 1, an integral paint brush holder 10 in accordance with the present invention is adapted for use with a container 12 that has a bottom surface 14, an inner side wall 16 and an upper edge 18. The container 12 may be a bucket, pail or any other suitable container for holding and carrying fluids. For example, the container 12 may be a conventional five-gallon bucket type made from plastic or metal. Furthermore, the container 12 may have a lid (not shown). The upper edge 18 of the container 12 receives the lid to keep the holder 10 within the container 12.

As illustrated in FIG. 1, the holder 10 has a base 22 and a post 24. The post 24 has a lower end 26, an intermediate portion 28 and an upper end 30. The lower end 26 is connected to the base 22. The intermediate portion 28 extends upwardly from the lower end 26 of the post 24. In addition, the intermediate portion 28 may also incline radially inward from the base 22 (also shown in FIG. 2). Furthermore, the upper end 30 is supported above the intermediate portion 28 of the post 24.

Figure 2:
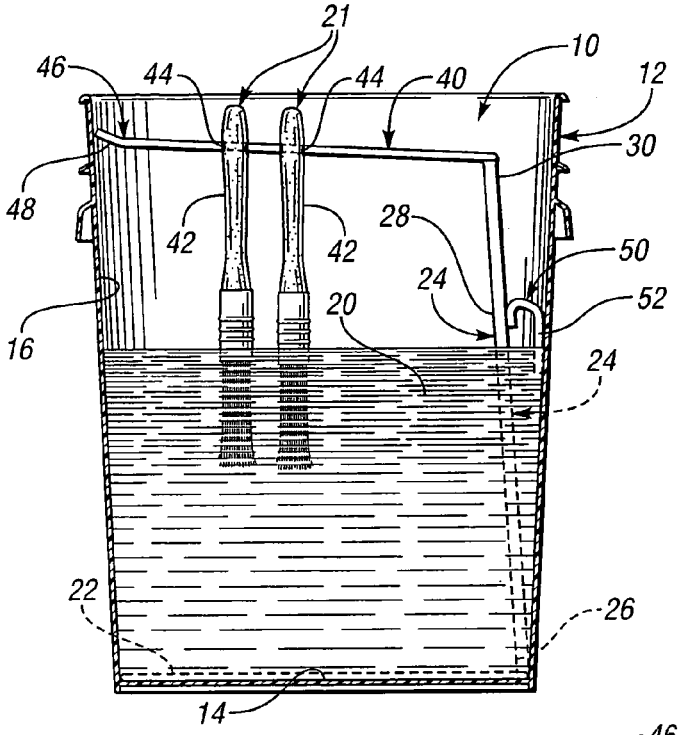
FIG. 2 is a side view showing the paint brush holder inserted within the container which is shown in section.

FIG. 2 shows the paint brush holder 10 in an "inserted position." When the holder 10 is in the "inserted position," the base 22 of the holder 10 contacts the bottom surface 14 of the container 12. The inner side wall 16 of the container 12 may be tapered radially outward such that the inner side wall 16 near the bottom surface 14 of the container 12 has a smaller diameter than the inner side wall 16 farther upwardly from the bottom surface 14. The container 12 may hold a fluid 20, such as solvent or water, such that when the paint brush holder 10 is the "inserted position," the fluid 20 will moisten and clean at least one brush 21 supported on the holder 10.

With continuing reference to FIG. 2, the base 22 may also contact the inner side wall 16 of the container 12 to help support the holder 10 in the "inserted position." When the base 22 contacts the inner side wall 16 of the container 12, a frictional force (not shown) between the base 22 and the inner side wall 16 of the container 12 exists. The frictional force between the base 22 and the inner side wall 16 helps to prevent the holder 10 from accidentally moving out from the "inserted position" and away from the bottom surface 14 of the container 12. If the holder 10 moves out from the "inserted position," the brush 21 supported on the holder 10 may be removed from the fluid 20 contained within the container 12 and cause the brush 21 to dry out and/or become damaged. Situations where the holder 10 may accidentally move away from the bottom surface 14 of the container 12 include when the container 12 is transported and when the bottom surface 14 of the container 12 is tilted at an angle relative to a horizontal plane (now shown).

With reference to FIGS. 1, 5*a*, 5*b*, 5*d* and 5*e*, the base 22 of the paint brush holder 10 may be a curved base 22. The curved base 22 may be a ring base 32 (shown in FIG. 1), a biasing ring-like base 33 (shown in FIG. 5*a*), a D-shaped base 34 (shown in FIG. 5*b*), a partially circular base 36 (shown in FIG. 5*d*), a circular disk base 38 (shown in FIG. 5*e*), or any other suitably shaped base to vertically support the intermediate portion 28 of the post 24. When the paint brush holder 10 is in the inserted position (shown in FIG. 2), the curved base 22 contacts the bottom surface 14 of the container 12 to upwardly support the intermediate portion 28 of the post 24.

Figure 5A:
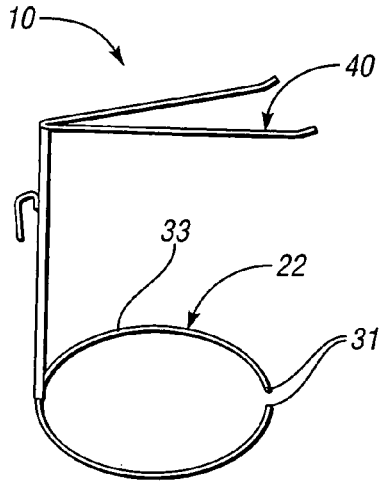
FIG. 5*a* is a perspective view illustrating the paint brush holder having a biasing ring-like base.
Figure 5B:
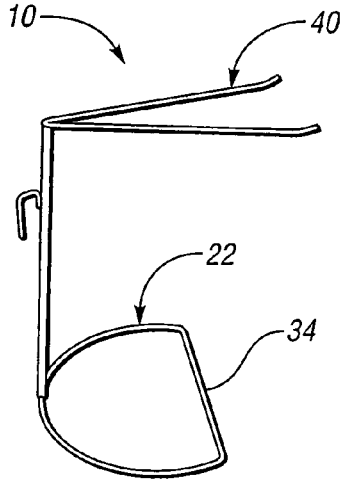
FIG. 5*b* is a perspective view illustrating the paint brush holder having a D-shaped base.

As illustrated in FIG. 5*a*, the biasing ring-like base 33 of the holder 10 may have two ring-like prongs 31. When the holder 10 is not in the "inserted position" (shown in FIG. 2), the prongs 31 may be unbiased and have a larger diameter than the inner side wall 16 near the bottom surface 14 of the container 12. When the holder 10 is in the "inserted position" (shown in FIG. 2), the prongs 31 of the biasing ring-like base 33 may bend radially inward and bias the ring-like base 33 against the inner side wall 16 of the container 12. When the prongs 31 bias against the inner side wall 16, additional force is required to remove the holder 10 from the container 12 than if the prongs 31 did not bias against the container 12. The additional force required to remove the holder 10 helps to prevent the holder 10 from accidentally moving out from the "inserted position."

Figure 5C:
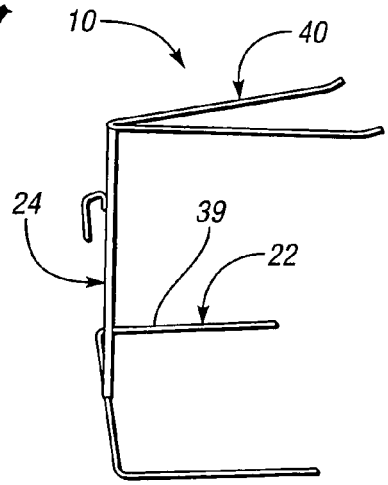
FIG. 5*c* is a perspective view showing the paint brush holder having a squared U-shaped base.
Figure 5D:
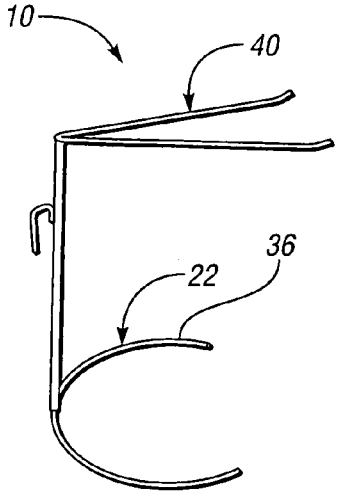
FIG. 5*d* is a perspective view illustrating the paint brush holder having a partially circular base.

With reference to FIG. 5*c*, the base 22 of the paint brush holder 10 may be a squared U-shaped base 39. The squared U-shaped base 39 may be formed of round rod. In addition, the squared U-shaped base 39 may have two bends on opposing sides of the post 24. The squared U-shaped base 39 may be used with the container 12 that has a generally rectangularshaped inner side wall (not shown), but may also be used with the container 12 that has the inner side wall 16 being generally circular (as show in FIG. 1).

Figure 5E:
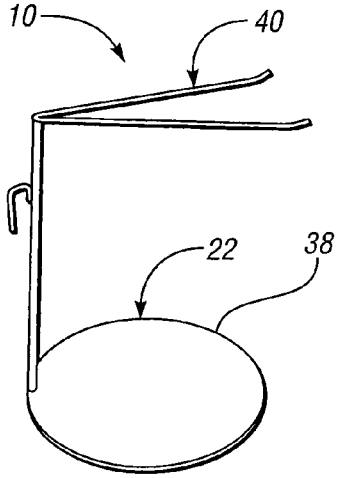
FIG. 5*e* is a perspective view illustrating the paint brush holder having a circular disk base.

As shown in FIG. 5*e*, the base 22 of the paint brush holder 10 may also be the circular disk base 38. As shown in FIG. 2, when the paint brush holder 10 is in the inserted position, the circular disk base 38 contacts the bottom surface 14 of the container 12 and impedes removal of the holder 10 from the container 12. The circular disk base 38 impedes removal of the paint brush holder 10 from the container 12 by weighting the lower end 26 of the post 24. Furthermore, when the container 12 is filled with the fluid 20, the circular disk base 38 impedes removal of the paint brush holder 10 due to fluid resistance as the holder 10 moves against the fluid 20 and away the bottom surface 14 of the container 12 (shown in FIG. 2).

Figure 3:
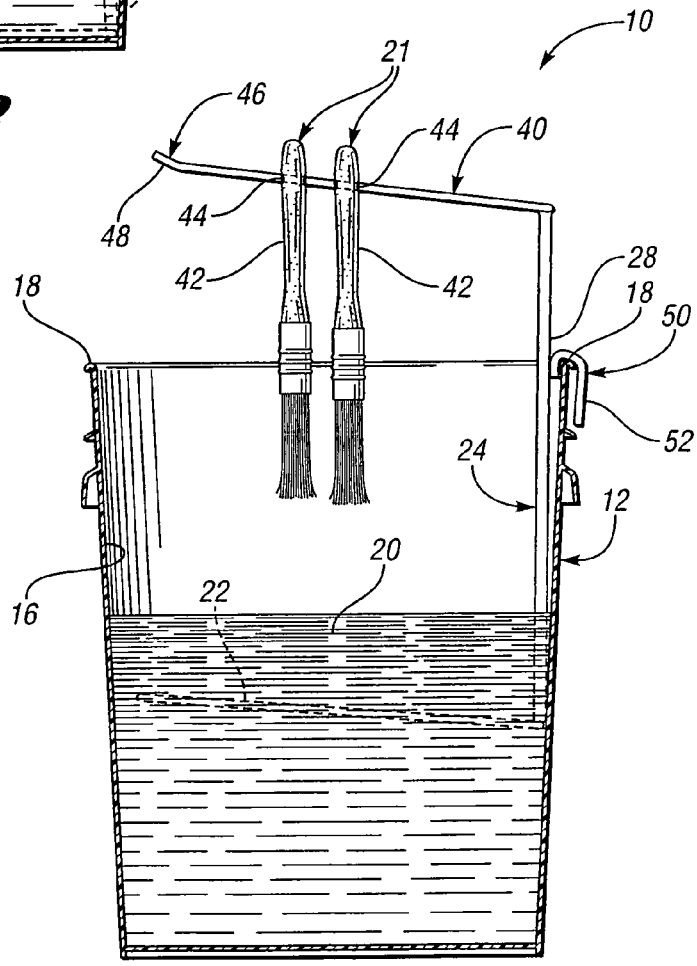
FIG. 3 is a side view like FIG. 2, but illustrating the paint brush holder supported on an upper edge of the container.

As shown in FIGS. 1-5, the integral paint brush holder 10 has at least one generally horizontal support 40. FIGS. 2 and 3 show the holder 10 having one horizontal support 40, however the holder 10 may have two or more horizontal supports 40 as shown in FIGS. 1, 4 and 5*a*, 5*b*, 5*c*, 5*d* and 5*e*.

As illustrated in FIGS. 2 and 3, the horizontal support 40 is used to hold the brush 21 on the paint brush holder 10. The brush 21 may have a handle portion 42 that includes an opening 44. The brush 21 may be hung in a generally vertical orientation on the horizontal support 40 through the opening 44 in the handle portion 42 of the brush 21.

Figure 4:
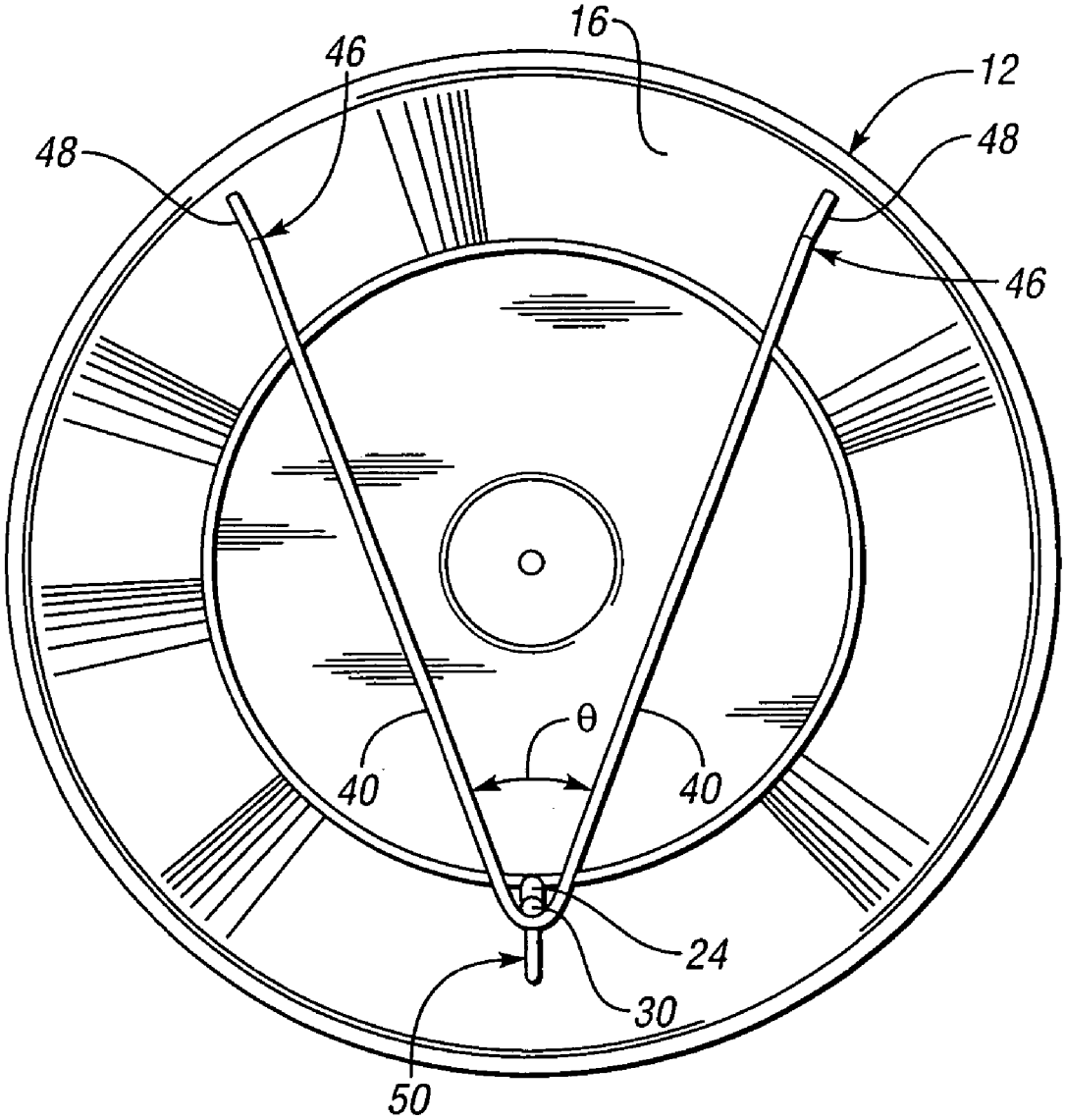
FIG. 4 is a top view showing the paint brush holder inserted within the container.

With reference to FIGS. 2 and 4, the horizontal support 40 extends from the upper end 30 of the post 24. The horizontal support 40 may extend from the upper end 30 to the inner side wall 16 of the container 12 to prevent accidental removal of the at least one brush 21 (shown in FIG. 2) supported on the horizontal support 40 from the horizontal support 40 when the holder 10 is the inserted position as shown in FIGS. 2 and 4.

With continuing reference to FIGS. 2-4, the generally horizontal support 40 of the paint brush holder 10 has an associated distal end 46. The distal end 46 may have an upwardly inclined shape 48 to help prevent accidental removal of the brush 21 from the support 40. The distal end 46 may help prevent accidental removal of the brush 21 both when the holder 10 is in the inserted position (shown in FIGS. 2 and 4) and when the holder 10 is positioned on the upper edge 18 of the container 12 (shown in FIG. 3). The distal end 46 also prevents the at least one brush 21 from sliding past the distal end 46 of the generally horizontal support 40 and contacting the inner side wall 16 of the container 12. Contact between the brush 21 and the inner side wall 16 of the container 12 can damage the bristles of the brush 21.

As shown in FIG. 4, if two or more horizontal supports 40 exist, each horizontal support 40 may be at an angle less than ninety degrees (indicated by the symbol θ) from an adjacent horizontal support to provide sufficient spacing between the brush 21 (not shown) hung from the horizontal support 40 and the inner side wall 16 of the container 12.

With reference to FIGS. 1-3, the paint brush holder 10 has a hook 50. The hook 50 is on the intermediate portion 28 of the post 24 vertically between the base 22 and the generally horizontal support 40. The hook 50 has a downwardly opening shape. The downwardly opening shape may include a downwardly J-shaped opening 52. The J-shaped opening 52 makes manufacturing of the hook 50 relatively simple and inexpensive. Furthermore, the J-shaped opening 52 provides spacing between the intermediate portion 28 of the post 24 and the inner side wall 16 of the container 12 to facilitate removal of the hook 50 from the upper edge 18 of the container 12.

With reference to FIG. 3, the holder 10 may be partially removed from the container 12 and positioned on the upper edge 18 of the container 12 using the hook 50. The downwardly opening shape of the hook 50 receives the upper edge 18 of the container 12 when the holder 10 is positioned on the upper edge 18 of the container 12. When the holder 10 is supported on the upper edge 18 of the container 12, the holder 10 is at a position above the inserted position (shown in FIG. 2) to allow drying of the brush 21 as well as removal of the brush 21 from the holder 10.

As shown in FIGS. 2-4, the hook 50 may extend in the opposite direction as the radial inward inclination of the post 24. The hook 50 extending in the opposite direction as the inclination of the post 24 permits proper positioning of the horizontal support 40 relative to the container 12 when the holder 10 is supported on the upper edge 18 of the container 12. Proper positioning of the horizontal support 40 helps to prevent contact between the brush 21 (shown in FIGS. 2 and 3) and the inner side wall 16 of the container 12, which could damage to the bristles of the brush 21.

As illustrated in FIG. 2, the hook 50 may contact the inner side wall 16 of the container 12 to provide a radially inward-directed force (not shown) to prevent the distal end 46 of the horizontal support 40 from disengaging the inner side wall 16 of the container 12. If the distal end 46 of the horizontal support 40 disengages the inner side wall 16 of the container 12, then the brush 21 may be accidentally removed from the horizontal support 40 when the holder 10 is in the inserted position. Furthermore, if the distal end 46 of the horizontal support 40 disengages the inner side wall 16 of the container 12, then the paint brush holder 10 may accidentally move out from the inserted position and rattle within the container 12. Rattling of the holder 10 within the container 12 can cause stress and damage to the holder 10 as well as damage to the bristles of the brush 21 if the bristles of the brush 21 contact the inner side wall 16 of the container 12.

The hook 50 as well as the base 22, post 24 and support 40 may be formed of round rod. Round rod may be made of metal such as aluminum, stainless steel and various rust-resistant metal alloys.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An integral paint brush holder for removable insertion use with a container having a bottom surface, an inner side wall and an upper edge, the holder comprising:

a base;

a post having a lower end connected to the base, an intermediate portion extending upwardly from the lower end and inclined inward from the base, and an upper end supported above the intermediate portion;

at least one generally horizontal support extending from the upper end of the post and each having an associated distal end; and a hook on the intermediate portion of the post vertically between the base and the support, and having a downwardly opening shape to permit the holder to be supported on the upper edge of the container at a position above an inserted position in the container;

wherein the hook extends in the opposite direction as the inward inclination of the intermediate portion to permit the holder to be raised and supported on the upper edge of the container at a position above the inserted position.

2. The paint brush holder of claim 1, wherein the distal end of each support has an upwardly inclined shape to prevent brush removal from the support.

3. The paint brush holder of claim 1, wherein the support extends from the upper end of the post to the inner side wall of the container to prevent brush removal from each generally horizontal support when the paint brush holder is the inserted position.

4. The paint brush holder of claim 1, wherein the hook and the support contact the inner side wall of the container to prevent brush removal from each generally horizontal support when the paint brush holder is in the inserted position.

5. The paint brush holder of claim 1, wherein the base is a circular disk base adapted to contact the bottom surface of the container and impede removal of the paint brush holder from the container.

6. The paint brush holder of claim 1, wherein the downwardly opening shape of the hook on the intermediate portion has an inverted J shape.

7. The paint brush holder of claim 1, wherein the base is a curved base adapted to contact the bottom surface of the container when the paint brush holder is in the inserted position.

8. The paint brush holder of claim 7, wherein the curved base is adapted to contact the inner side wall of the container.

9. The paint brush holder of claim 8, wherein the curved base is a ring base.

10. The paint brush holder of claim 8, wherein the curved base is a partially circular base.

11. The paint brush holder of claim 8, wherein the curved base is a D-shaped base.

12. The paint brush holder of claim 1, wherein the at least one generally horizontal support includes at least two generally horizontal supports, wherein each support extends from the upper end of the post and each support has the distal end having an upwardly inclined shape.

13. The paint brush holder of claim 12, wherein each support is at an angle less than ninety degrees from an adjacent support.

14. The paint brush holder of claim 1, wherein the base, post, support and hook are formed from round rod, wherein the round rod of the post has a larger rod gauge than the round rod of the base, support and hook.

15. The paint brush holder of claim 1, wherein the base is a squared U-shaped base.

16. An integral paint brush holder for removable-insertion use with a container having a bottom surface, an inner side wall and an upper edge, the holder comprising:

a base;

a post having a lower end connected to the base, an intermediate portion extending upwardly from the lower end and inclined radially inward from the base, and an upper end supported above the intermediate portion;

at least one generally horizontal support extending from the upper end of the post and each having an associated distal end;

the distal end of each support having an upwardly inclined shape; and a hook on the intermediate portion of the post vertically between the base and the support, and having a downwardly opening shape, and extending in the opposite direction as the radial inward inclination of the post to permit the holder to be raised and supported on the upper edge of the container at a position above an inserted position in the container.

17. An integral paint brush holder for removable-insertion use with a container having a bottom surface, an inner side wall and an upper edge, the holder comprising:

a ring-like base formed from round rod and adapted to contact the bottom surface of the container as well as the inner side wall of the container when the holder is in an inserted position in the container;

a post formed from round rod and having a lower end connected to the base, an intermediate portion extending upwardly from the lower end and inclined radially inward from the base, and an upper end supported above the intermediate portion;

generally horizontal supports formed from round rod and extending from the upper end of the post to the inner side wall of the container to prevent brush removal from each support when the holder is the inserted position, wherein each support extends at an angle less than ninety degrees from the upper end of the post relative to an adjacent support, and wherein each support has an associated distal end having an upwardly inclined shape; and a hook on the intermediate portion of the post vertically between the base and the supports, formed from round rod, having a downwardly J-shaped opening, and extending in the opposite direction as the radial inward inclination of the post to permit the holder to be raised and supported on the upper edge of the container at a position above the inserted position.

* * * * *